United States Patent [19]

Shukuri et al.

[11] Patent Number: 4,506,975

[45] Date of Patent: Mar. 26, 1985

[54] CLEANING DEVICE

[75] Inventors: Katsuhiro Shukuri; Shigeru Inowa, both of Hino; Kiyoaki Kawamoto, Kunitachi, all of Japan

[73] Assignee: Konishiroku Photo Industry Co., Ltd., Tokyo, Japan

[21] Appl. No.: 449,380

[22] Filed: Dec. 13, 1982

[30] Foreign Application Priority Data

| | | | |
|---|---|---|---|
| Dec. 24, 1981 | [JP] | Japan | 56-208099 |
| Dec. 24, 1981 | [JP] | Japan | 56-208100 |
| Dec. 28, 1981 | [JP] | Japan | 56-209825 |

[51] Int. Cl.[3] ..... G03G 15/08

[52] U.S. Cl. ..... 355/15; 118/639; 118/652; 430/123; 430/125

[58] Field of Search ..... 355/15, 3 DD, 14 D; 118/652, 656, 639; 430/123, 125

[56] References Cited

U.S. PATENT DOCUMENTS

| | | | |
|---|---|---|---|
| 3,883,292 | 5/1975 | Hamaker | 355/15 X |
| 3,917,397 | 11/1975 | Tanaka et al. | 355/15 |
| 3,942,889 | 3/1976 | Kurita et al. | 355/15 |
| 4,123,154 | 10/1978 | Fisher | 355/15 |
| 4,263,390 | 4/1981 | Yamashita et al. | 355/15 X |
| 4,361,922 | 12/1982 | Karal | 355/15 X |

*Primary Examiner*—A. C. Prescott

*Attorney, Agent, or Firm*—Jordan B. Bierman

[57] ABSTRACT

A cleaning device in which toner remaining on an image reproducing support through an electrostatic reproducing process is cleaned by a fur brush and then the toner having adhered to the fur brush is recovered by an electrically biased roller, the fur brush having a brush core formed of a conductive material and the brush core being grounded or biased with the polarity opposite to that of bias voltage applied to the roller. The fur brush is formed as a conductive brush and grounded through a non-linear resistance element. The fur brush is formed of a semiconductive material.

8 Claims, 5 Drawing Figures

CLEANING DEVICE

BACKGROUND OF THE INVENTION

1. Field of the Invention

This invention relates to a cleaning device for an electrostatic reproducing apparatus, which can reduce an extent of fog due to a failure of cleaning, prevent deterioration of photosensitive members, and provide a stable cleaning effect without suffering any influence from circumstances at all times.

2. Description of the Prior Art

In electrostatic reproducing apparatus including an electrophotographic reproducing machine, electrostatic non-impact printer, facsimile and the like, recording images are reproduced, for example, in such a manner that a reflected light or an electrical information signal obtained through scanned exposing of a document is used to form an electrostatic latent image of the document or the electrical information on a photosensitive or dielectric member, the electrostatic latent image is developed and converted into a visible image, and the visible image is transferred onto recording paper and then fixed. Referring to FIG. 1 there is shown a schematic arrangement of a electrophotographic reproducing machine in the prior art. Light from an illuminating lamp 2 is irradiated onto a document G placed on a document glass plate 1 which is moving in the direction indicated by a solid arrow. Reflected light from the document G is projected on a photosensitive member 3*a* of a rotary drum 3 rotating in the direction indicated and hence an electrostatic latent image of the document G is formed on the photosensitive member 3*a*. A charging electrode 4 adapted to uniformly charge the photosensitive member 3*a*, a developing device 5, a transferring electrode 6, a separation electrode 7, a charge eliminating electrode 8 and a cleaning device (fur brush type) 9 are disposed in the periphery of the rotary drum 3 in due order. The electrostatic latent image is developed by the developing device 5 to be converted into a visible image and this visible image is transferred through the transferring electrode 6 onto recording paper P which is fed with a conveyance unit 11 from a paper feeding unit 10 such as a cassette. After transferring, the recording paper P is separated from the photosensitive member 3*a* through the separation electrode 7 and then sent to a fixing device 13 with another conveyance unit 12, wherein it is sent out to a paper discharging tray 14 after fixing.

To permit a repeated use of the photosensitive member 3*a*, it is required in the apparatus as mentioned above to remove electric charges and toners which remain on the surface of the photosensitive member 3*a* even after transferring among the series of aforesaid electrophotographic processes. So the residual electric charges are removed by the charge eliminating electrode 8 and the residual toners are removed by the cleaning device 9, respectively.

As a cleaning device used for electrophotographic reproducing machines, there are known a fur brush type, blade type and a magnetic brush type. The fur brush type is of a method such that a fur brush made of furs of animals such as a rabbit or synthetic fibers is continuously rotated to remove toners remaining on the surface of the photosensitive member, the toners having adhered to the fur brush are shaken off by a toner shaking-off plate (the so-called flicker bar) which is disposed in contact with the fur brush, and then the shaken-off toners are suctioned under vacuum or with a fan to be recovered through a filter. The blade type is of a method such that a blade formed of an elastic synthetic resin is press-abutted onto the surface of the photosensitive member thereby to remove the residual toners. Meanwhile, the magnetic type is of a method such that a non-magnetic cylindrical sleeve including therein magnet groups, which are disposed to have different polarities alternately, is provided near the surface of the photosensitive member, the magnet groups are rotated thereby to attract and remove the toners remaining on the surface of the photosensitive member, and the toners on the sleeve surface are shaken off by a blade or the like to be recovered. In recent years, along with an advent of high-speed reproducing machines and an increase in a moving speed of the photosensitive member, the fur brush type has been adopted in such high-speed machines because the blade type can not provide a satisfactory cleaning effect. Particularly, the fur brush has additional advantageous features that it will not damage the surface of the photosensitive member, e.g., selenium drum, unlike the blade which is pressed thereon, fine solids will not adhere to the brush and lead to damage, and hence the service life of the photosensitive member can be prolonged. For that reason, there is a tendency toward a widespread use of the fur brush type cleaning device.

In the conventional cleaning device of fur brush type, a fur brush is rotated at a high speed in sliding contact with the surface of a photosensitive member thereby to brush off toners remaining on that surface, the toners having adhered to the brush fibers are shaken off by a flicker bar which is disposed in contact with the brush fibers, and then the shaken-off toners are suctioned by a fan to be recovered with a filter bank. However, the use of the filter bank and the fan requires a large space. Thus, instead of those members, an electrically biased electrode member (referred to as a recovering roller hereinafter) is rotated in contact with the brush fibers of the fur brush, so that the toners having adhered to the brush fibers are electrostatically transfered onto the recovering roller and then the transferred toners are scraped off by a toner scraping-off blade which is provided in contact with the recovering roller (for example, Japanese Patent Publication No. 20,227/74). By so doing, it becomes possible to reduce the size of the cleaning device.

In the fur brush type cleaning device using the aforesaid recovering roller, a bias voltage is applied to the recovering roller and a current flows into the photosensitive member from the recovering roller through the brush fibers. Therefore, the device may suffer the problem that the electric charges of toners on the surface of the photosensitive member are decreased, or the polarity of the electric charges of toners is changed in the case of large bias voltage. Hence, the electrostatic attraction force between the brush fibers and the toners is so reduced that it becomes hard for the toners brushed off through a friction of the brush fibers with the photosensitive member to adhere to the brush fibers. As a result, the toners brushed off by the brush fibers are liable to adhere onto the photosensitive member once again, whereby there occurs fog or a filming phenomenon in which the toners on the photosensitive member are melted with friction heat generated between the brush fibers and the photosensitive member and then adhered onto the photosensitive member in the form of a thin film. Upon this, deterioration of the photosensitive member is accelerated and a service life thereof is shortened. Moreover, among the toners adhering to the brush fibers, those toners having adhered near the brush core become hard to transfer on the recovering roller, so that the brush fibers are liable to be clogged with toners. FIG. 2 shows the relationship between the bias voltage applied to the recovering roller and the current flowing into the photosensitive member in the case where the brush fibers are made of rayon.

Further, in the fur brush type cleaning device using the aforesaid recovering roller, the toners having adhered to the brush fibers are electrostatically attracted thereto with the aid of frictional electricity on the brush fibers of the fur brush and hence, the electrostatic attraction force between the brush fibers and the toners on the surface of the photosensitive member is relatively large. Therefore, the toners having adhered to the brush fibers are not transferred onto the recovering roller completely and this may lead to the problem that the toners are melted and firmly stick to the brush fibers, the brush fibers are soiled with the toners, and an electrostatic attraction force between the brush fibers and the toners is decreased, thus not resulting in a stable cleaning effect. On the other hand, since frictional electricity on the brush fibers is liable to suffer an influence of humidity, the potential of charged electricity on the brush fibers is largely changed depending on the circumstance. For example, under the circumstance of high humidity, the potential of charged electricity on the brush fibers becomes small and a sufficient cleaning effect can not be attained.

Accordingly, there is proposed a method wherein conductive brush fibers are used to impart the potential to the brush fibers in place of insulative brush fibers. But in this case, since the state of toners having adhered to the brush fibers and the contact state of the brush fibers with the recovering roller are not always constant, the potential of the brush fibers may be changed, thus not resulting in a stable cleaning effect.

In addition, the potential of the brush fibers is increased due to friction with the photosensitive member, so that it becomes hard for the toners having adhered to the brush fibers to move onto the recovering roller, even if high voltage (e.g., 3 to 5 kV) of polarity opposite to that of the toners is applied to the recovering roller. As a result, a part of the toners will be left on the brush fibers and newly coming toners will adhere onto the remaining toners, whereby the brush fibers will be soiled with the toners firmly stuck to the brush fibers. Consequently, there may occur a failure of cleaning because of the reduced electrostatic attraction force between the brush fibers and the toners, or a normal cleaning effect may not be obtained because the toners having once adhered to the brush fibers will be transfered back to the surface of the photosensitive member again. To cause the toners to easily move onto the recovering roller, there is also proposed such a method that electric charges on the brush fibers are eliminated by a corona electrode before the brush fibers including the toners adhered thereto comes into contact with the recovering roller. But in this case, the corona electrode is apt to be soiled due to dispersion of the toners, whereby there arises the problem that a stable discharge can not be sustained and the cost is increased.

On this occasion, when employing conductive brush fibers in place of insulative brush fibers, the brush fibers can not hold the proper potential and the toners having adhered on the surface of the photosensitive member will not move onto the brush fibers, so that the desired cleaning effect can not be attained.

SUMMARY OF THE INVENTION

This invention has been accomplished in view of the foregoing situations and is to provide a cleaning device in which a powdered developer such as toners remaining on an image reproducing support such as a photosensitive member or a dielectric member is cleaned by means of a fur brush, and then the powdered developer having adhered to the fur brush is recovered through an electrically biased roller, the fur brush having a brush core formed of a conductive material and the brush core being grounded or biased with a polarity opposite to the bias voltage of the roller.

By so doing, an extent of fog due to a failure of cleaning can be reduced and a filming phenomenon of the photosensitive member can be prevented, thus resulting in a prolonged service life of the photosensitive member.

Another object of this invention is to provide a cleaning device in which the fur brush is formed as a conductive brush and this conductive brush is grounded through a non-linear resistance element.

By so doing, a stable cleaning effect can be attained without suffering any influence from the circumstances, and soiling of the fur brush with toners can be decreased as far as possible.

Still another object of this invention is to provide a cleaning device in which the fur brush is formed of a semiconductive material.

By so doing, it becomes possible to attain satisfactory cleaning effect and to assuredly recover the toners from the fur brush.

Other objects and features of this invention will be apparent from the following description with reference to the drawings.

DESCRIPTION OF THE PREFERRED EMBODIMENTS

Figure 1:
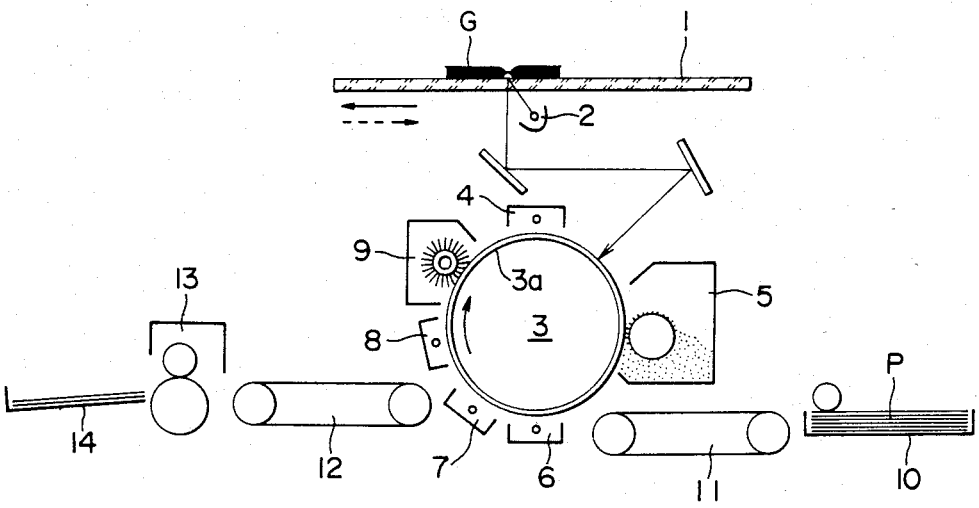
FIG. 1 is a schematic view showing an arrangement of an electrostatic reproducing apparatus.
Figure 2:
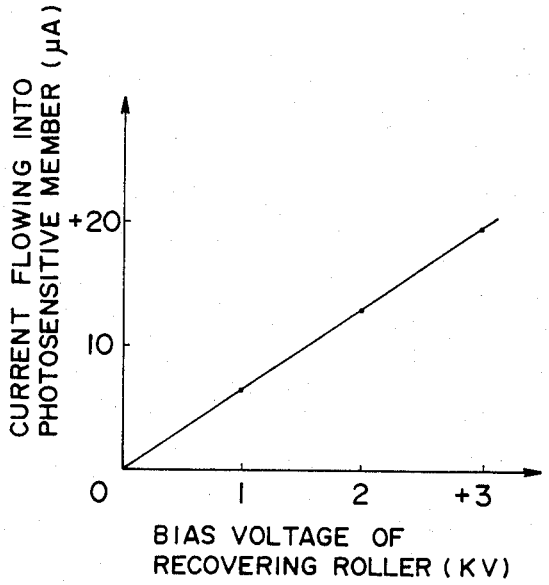
FIG. 2 is a characteristic view showing the relationship between bias voltage of the recovering roller and current flowing into the photosensitive member in the case the brush fibers are made of rayon.
Figure 3:
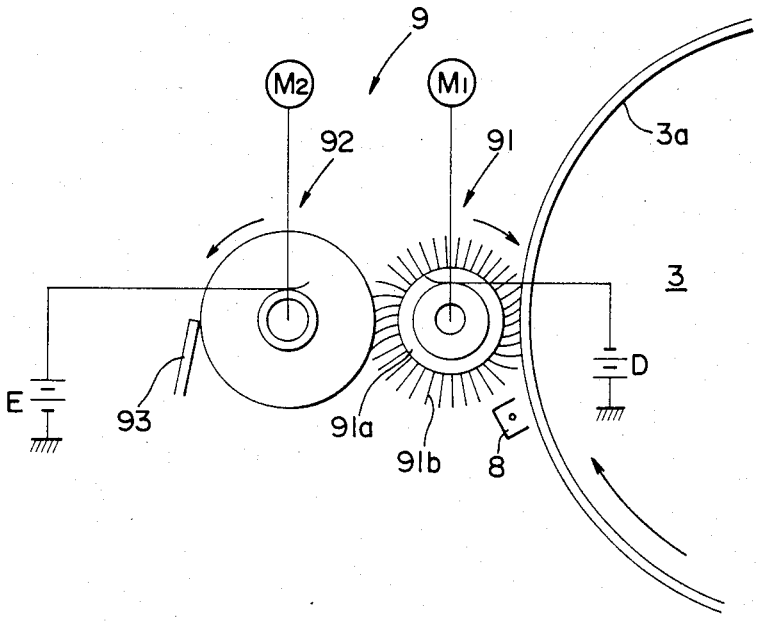
FIG. 3 is a schematic diagram of a fur brush type cleaning device according to the invention.

Referring to FIG. 3 there is illustrated a schematic diagram showing an arrangement of a fur brush type cleaning device according to this invention. Reference numeral 3 designates a rotary drum having a photosensitive member 3*a* on its periphery, 8 designates a charge eliminating electrode and 9 designates a cleaning device. The cleaning device 9 comprises: a fur brush 91 rotated by a motor $M_1$ and including a conductive brush core 91*a* to which negative voltage is applied from a power supply D, and brush fibers 91*b* such as synthetic fibers which are planted on the periphery of the brush core 91*a;* a conductive recovering roller 92 to which positive polarity is applied from a power supply E and which is rotated by a motor $M_2$; and a toner scraping-off blade 93 disposed in contact with the recovering roller 92.

To remove toners by the cleaning device thus arranged, the fur brush is rotated at a high speed in the direction indicated to come into a sliding contact with the rotary drum 3 rotating in the direction indicated, so that the toners adhering to the surface of the photosensitive member 3*a* are now electrostatically adhered to the brush fibers 91*b*. Thus adhered toners are transferred onto the recovering roller 92 rotating in the direction indicated by an arrow while keeping a contact with the brush fibers 91*b*, and then the transferred toners are scraped off by the toner scraping-off blade 93.

Figure 4:
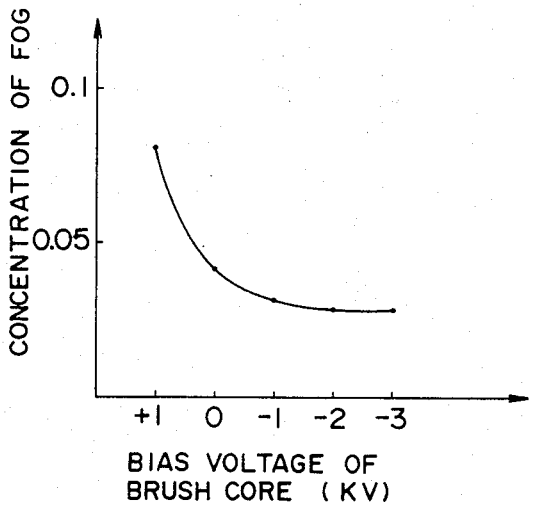
FIG. 4 is a characteristic view showing the concentration of fog with respect to bias voltage of the brush core.

In this way, since the conductive brush core 91*a* is used and the bias voltage of the polarity opposite to that of the recovering roller 92 is applied to the brush core 91*a* in the above embodiment, most of the current passing from the recovering roller 92 to the brush fibers 91*b* flows into the side of the brush core 91*a*. Therefore, the current will hardly flow into the photosensitive member, so that electric charges of toners on the surface of the photosensitive member will not be decreased and the polarity of electric charges will not be changed, thus not leading to the reduction in toner attraction force of the brush fibers 91*b*. As a result, the toners brushed off through the friction of the brush fibers 91*b* with the photosensitive member 3*a* surely adhered to the brush fibers 91*b* and hence, a filming phenomenon and fog due to a failure of cleaning can be reduced, thus resulting in an improved quality of the reproduced images. FIG. 4 shows the result of experiment in which the fog due to a failure of cleaning is sampled by a cellophane tape and the reflection concentration due to the fog is measured. As seen from the FIG. 4, the concentration of fog can be more decreased as the bias voltage of the brush core 91*a* becomes larger. Moreover, since the brush core 91*a* is applied with the bias voltage of the same polarity as the electric charges of the toners, the toners become hard to transfer to the side of the brush core 91*a* and are made to adhere relatively near the tip end of the brush fibers. Hence, it becomes easier for the toners to transfer onto the recovering roller 92 and to prevent clogging of the brush fibers 91*b* with toners as far as possible.

The brush core used in this embodiment may be formed of a metal or may be modified into such a structre that a conductive thin film such as an aluminum foil is wound round a paper tube and a base cloth including brush fibers woven into the cloth is bonded thereto with conductive adhesives. When metal wires are woven into the base cloth, the cleaning effect is increased. In other words, it is enough that the brush core is conductive and has a structure permitting the electrical processing. Instead of using the method wherein bias voltage is applied to the brush core, the brush core may be grounded.

The cleaning device of this invention is also applicable to an image reproducing support formed of a dielectric member, in addition to the photosensitive member as stated above.

According to this invention, as fully described hereinabove, there is obtained a cleaning device in which toners remaining on the image reproducing support such as a photosensitive member or a dielectric member are cleaned by means of a fur brush and then the toners having adhered to the fur brush are recovered by an electrically biased roller, the fur brush having a brush core formed of a conductive material and the brush core being grounded or biased into the polarity opposite to that of bias voltage applied to the roller. With this arrangement, the concentration of fog due to a failure of cleaning is decreased and the photosensitive member is prevented from suffering a filming phenomenon, thus improving the quality of images and resulting in a prolonged service life of the photosensitive member.

Figure 5:
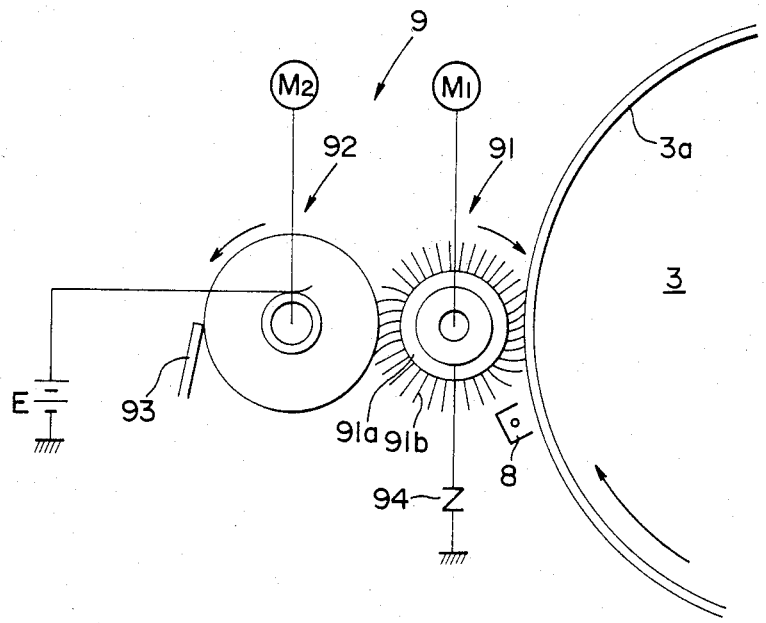
FIG. 5 is a schematic diagram showing another embodiment of the invention.

In another embodiment of this invention, the cleaning device as shown in FIG. 3 is modified in such a manner that the conductive brush fibers 91*b* are formed by mixing carbon or the like into synthetic fibers and a non-linear resistance element, e.g., a varistor 94 is provided which has its one end connected to the fur brush 91 and the other end grounded, as shown in FIG. 5. Bias voltage of 1 kV is applied to the recovering roller 92 from the power supply E. The varistor 94 is selected to give voltage of 600 V across the same independent of changes in current. By so doing, current flows into the varistor 94 through the recovering roller 92 and the conductive brush fibers 91*b* and the potential of the brush fibers 91*b* is held at 600 V constantly, so that a difference in potential between the brush fibers 91*b* and the photosensitive member 3*a* becomes equal to 600 V. As a result, a difference in potential between the brush fibers 91*b* and the recovering roller 92 becomes 400 V.

In this way, since the varistor 94 is connected to the fur brush 91 in this embodiment, the brush fibers 91*b* are made to have the predetermined constant potential and hence, a difference in potential between the brush fibers 91*b* and the photosensitive member 3*a* and a difference in potential between the brush fibers 91*b* and the recovering roller 92 can be held at constant, respectively. Thus, an electrostatic attraction force between the brush fibers 91*b* and the toners on the photosensitive member 3*a* becomes almost constant at all times and hence, most of the toners are transferred to the brush fibers 91*b*. Furthermore, an electrostatic attraction force between the toners having adhered to the brush fibers 91*b* and the recovering roller 92 also becomes almost constant at all times, so that the toners are surely transferred onto the recovering roller 92 and this ensures recovery of the toners. Consequently, a stable cleaning effect can be always attained without suffering any influence from the particular circumstances. The brush fibers 91*b* can be prevented from soiling with toners as far as possible.

Now considering recovery of toners, a difference in potential between the brush fibers 91*b* and the recovering roller 92 is preferably selected to be in the range of 300 V to 500 V. Within this range, the toners having adhered to the brush fibers 91*b* can be transferred onto the recovering roller 92 to a sufficient degree. When the bias voltage of the recovering roller 92 is made less than 700 V, recovery of toners is lowered and hence, a range of 800 V to 1000 V is suitable as the bias voltage. On this occasion, even with voltage of the power supply E being increased, only an excessive current passes through and the bias voltage of the recovering roller 92 is not raised up, so that recovery of toners may not be improved. Meanwhile, potential of the brush fibers 91*b* is determined by the voltage of the varistor 94, preferably preset, and the brush fibers 91*b* are preferably subject to a voltage higher than 500 V. So it is preferred that the voltage applied to the brush fibers is selected to be within a range of 500 V to 600 V.

Although the varistor has been used as a non-linear resistance element in the above embodiment, this invention is not limited to such embodiment and a Zener diode may be used in place of the varistor.

In still another embodiment of this invention, the cleaning device as shown in FIG. 3 is modified in such a manner that a semiconductive material such as carbon fibers is employed as the brush fibers 91*b*. The overall resistance of the brush fibers 91*b* is selected to be within a range of $10^8\omega$ to $10^{10}\omega$, and a bias voltage of 1 kV is applied from the power supply E to the recovering roller 92, for example. By so doing, a current of 0.1 $\mu$A to 10 $\mu$A flows into the photosensitive member 3*a* through the recovering roller 92 and the brush fibers 91*b*. It is further preferable that the overall resistance of the brush fibers 91*b* is selected to be within a range of $10^8\omega$ to $10^9\omega$ so as to generate a current of 1 $\mu$A to 10 $\mu$A at that time.

In this embodiment, since the semiconductive brush fibers 91*b* are employed, the brush fibers 91*b* are made to have a certain value of resistance. Therefore, when current flows into the brush fibers 91*b* through the recovering roller 92, there occurs a drop in voltage due to resistance of the brush fibers 91*b*. As a result, the brush fibers 91*b* are held at a constant potential through such a drop in voltage and it becomes possible to keep the difference in potential between the brush fibers 91*b* and the photosensitive member 3*a* and a difference in potential between the brush fibers 91*b* and the recovering roller 92 almost constant, respectively. Accordingly, an electrostatic attraction force between the brush fibers 91*b* and the toners on the photosensitive member 3*a* becomes almost constant at all times and hence, most of the toners are transferred to the brush fibers 91*b*. Furthermore, an electrostatic attraction force between the toners having adhered to the brush fibers 91*b* and the recovering roller 92 also becomes almost constant at all times, so that the toners are surely transferred onto the recovering roller 92. This ensures recovery of the toners, thus resulting in a normal cleaning effect and eliminating the need of using an additional unit such as a corona electrode. On the other hand, since the brush fibers 91*b* are semiconductive, there is no possibility that electric charges are accumulated due to friction of the brush fibers 91*b*. Therefore, the potential of the brush fibers 91*b* is not increased up to so high level and, even if the bias voltage of the recovering roller 92 is as low as about 1 kV, the toners can be sufficiently transferred onto the recovering roller 92, so that the bias voltage of the recovering roller 92 can be restrained to a lower level.

What is claimed is:

1. A cleaning device for removing toner remaining on an image reproducing surface of an electrostatic reproducing member comprising a rotatable fur brush in contact with the toner-bearing surface of said electrostatic reproducing member, and an electrically biased roller which is made of an electrically conductive body and is disposed in moving contact with said fur brush for removing toner therefrom by electrical attraction, said fur brush having a brush core formed of a conductive material and said brush core being grounded.

2. A cleaning device for removing toner remaining on an image reproducing surface of an electrostatic reproducing member comprising a rotatable fur brush in contact with the toner-bearing surface of said electrostatic reproducing member, and an electrically biased roller which is made of an electrically conductive body and is disposed in moving contact with said fur brush for removing toner therefrom by electrical attraction, said fur brush having a brush core formed of a conductive material and said brush core being biased with a polarity opposite to that of a bias voltage applied to said roller.

3. A cleaning device for removing toner remaining on an image reproducing surface of an electrostatic reproducing member comprising a rotatable fur brush in contact with the toner-bearing surface of said electrostatic reproducing member, and an electrically biased roller which is made of an electrically conductive body and is disposed in moving contact with said fur brush for removing toner therefrom by electrical attraction, said fur brush being formed as a conductive brush and being grounded through a non-linear resistance element.

4. The cleaning device according to claim 3, wherein said non-linear resistance element is a varistor.

5. The cleaning device of claim 1, wherein said fur brush is formed of a semi-conductive material.

6. The cleaning device of claim 2, wherein said fur brush is formed of a semi-conductive material.

7. The cleaning device of claim 1, wherein said fur brush is formed of a electrically conductive material.

8. The cleaning device of claim 2, wherein said fur brush is formed of an electrically conductive material.

* * * * *